US006867792B2

(12) United States Patent
Hoshino et al.

(10) Patent No.: US 6,867,792 B2
(45) Date of Patent: Mar. 15, 2005

(54) FORWARDING AND CUTTING METHOD OF HEAT SENSITIVE ADHESIVE SHEET AND PRINTER FOR HEAT SENSITIVE ADHESIVE SHEET

(75) Inventors: Minoru Hoshino, Chiba (JP); Yoshinori Sato, Chiba (JP); Shinichi Yoshida, Chiba (JP); Akihiko Ito, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/397,857

(22) Filed: Mar. 26, 2003

(65) Prior Publication Data

US 2003/0189631 A1 Oct. 9, 2003

(30) Foreign Application Priority Data

Apr. 19, 2002 (JP) ..... 2002-117922

(51) Int. Cl.[7] ..... B41J 11/00
(52) U.S. Cl. ..... 347/218
(58) Field of Search ..... 347/218, 171–172, 347/174, 176, 221–222; 400/621, 614, 617; 156/384, 287

(56) References Cited

U.S. PATENT DOCUMENTS 6,031,553 A 2/2000 Nagamoto et al. ..... 347/171
6,172,698 B1 1/2001 Iwata et al. ..... 347/171
6,462,765 B1 * 10/2002 Conwell et al. ..... 347/171
6,731,319 B2 * 5/2004 Ichikawa et al. ..... 347/212

FOREIGN PATENT DOCUMENTS

EP 1088672 4/2001

OTHER PUBLICATIONS

Patent Abstracts of Japan, vol. 1999, No. 11, Sep. 30, 1999 publication No. 11 157141 A, (Teraoka Seiko Co Ltd), publication date Jun. 15, 1999.

* cited by examiner

*Primary Examiner*—K. Feggins
(74) *Attorney, Agent, or Firm*—Adams & Wilks

(57) ABSTRACT

Forwarding and cutting method of a heat sensitive adhesive sheet using a printing device for printing on a printable layer of a heat sensitive adhesive sheet formed by the printable layer on one surface of a sheet-shaped substrate and a heat sensitive adhesive layer on the other surface thereof and first forwarding device for forwarding the heat sensitive adhesive sheet in a predetermined direction, a cutter provided in a posterior stage to the printing device, a thermal activating device including heating means provided in the posterior stage to the cutter, for heating the heat sensitive adhesive layer and second forwarding device for forwarding the heat sensitive adhesive sheet in a predetermined direction, an operation of the first forwarding device is stopped so as to cut the sheet by the cutter after temporarily loosening the sheet between the cutter and the thermal activating device according to speed control of the first and second forwarding devices.

12 Claims, 8 Drawing Sheets

FORWARDING AND CUTTING METHOD OF HEAT SENSITIVE ADHESIVE SHEET AND PRINTER FOR HEAT SENSITIVE ADHESIVE SHEET

BACKGROUND OF THE INVENTION

1. Field of the Invention

The present invention relates to a printer having a thermal activating device of a heat sensitive adhesive sheet, for example, used as an adhesive label, in which a heat sensitive adhesive layer for developing adhesion by heating although exhibiting no adhesion at usual is formed on one surface of a sheet-shaped substrate, and more particularly to a forwarding and cutting method of the sheet.

2. Description of the Related Art

In these days, there prevails a stick-on label for use in displaying bar code, price list, and the like, which is made by forming a pressure sensitive adhesive layer on the back side of a recording surface (printing surface) thereof and temporarily attaching a separator on the above layer, hence to be held. In this type of stick-on label, however, the separator has to be peeled off from the pressure sensitive adhesive layer when using it as the label, which never avoids a disadvantage of producing wastes.

Accordingly, as a method of requiring no separator, there has been developed a heat sensitive adhesive label having a heat sensitive adhesive layer on the back surface of a sheet-shaped substrate, the layer exhibiting adhesion by the heating although exhibiting no adhesion at usual, and a thermal activating device for exhibiting the adhesion by heating the heat sensitive adhesive layer on the back surface of the above label.

For example, various heating methods of using a heating roller, a hot air heater, infrared ray emission, an electric heater, a dielectric coil, and the like as heating means are adopted to the thermal activating device. Further, for example, in JP-A-1999-79152, there is disclosed a technique of heating a heat sensitive adhesive layer while making a head contact with a heat sensitive adhesive label, the head having a plurality of resistive elements (heater elements) provided on a ceramic substrate as a heat source, like a thermal head used as a printing head of a thermal printer.

A general structure of the conventional printer for a heat sensitive adhesive sheet will be described with reference to a thermal printer P2 of FIG. 15.

The thermal printer P2 of FIG. 15 comprises a roll case unit 20 for holding a tape-shaped heat sensitive adhesive label 60 reeled like a roll, a printing unit 30 for printing on the heat sensitive adhesive label 60, a cutter unit 40 for cutting the heat sensitive adhesive sheet 60 into a label of a predetermined length, and a thermal activating unit 50 for thermal-activating the heat sensitive adhesive layer of the heat sensitive adhesive label 60 as the thermal activating device.

The heat sensitive adhesive label 60 has constitution that an insulating layer and a heat sensitive coloring layer (printable layer) are formed on the top surface of the sheet substrate, for example, and that a heat sensitive adhesive layer with heat sensitive adhesive applied and dried is formed on the back surface thereof.

The printing unit 30 comprises a printing thermal head 32 including a plurality of heater elements 31 formed by a plurality of comparatively small resistive elements which are aligned in the width direction in a way capable of dot printing, a printing platen roller 33 pushed toward the printing thermal head 32 (heater elements 31), and the like. In FIG. 15, the printing platen roller 33 is rotated clockwise and the heat sensitive adhesive label 60 is forwarded to the right side.

The cutter unit 40 is in order to cut the heat sensitive adhesive label 60 having been printed by the printing unit 30, to a proper length, and it comprises a movable blade 41 operated by a driving source (not illustrated) such as an electric motor, a fixed blade 42 fixed on a side opposite to the movable blade, and the like.

The thermal activating unit 50 comprises a thermal head 52 for thermal activation as heating means having a heater element 51, a platen roller 53 for thermal activation as forwarding means for forwarding the heat sensitive adhesive label 60, drawing rollers 54 for drawing the heat sensitive adhesive label 60 supplied from the side of the printing unit 30 into the space between the thermal head 52 for thermal activation (heater element 51) and the platen roller 53 for thermal activation, and the like. In FIG. 13, the platen roller 53 for thermal activation is rotated in the direction opposite to the printing platen roller 33 (counterclockwise in the drawing), so as to forward the heat sensitive adhesive label 60 in a predetermined direction (right side).

When the heat sensitive adhesive label loosens at a forwarding time, the label becomes wrinkled, or fails in proceeding so often, and therefore, the forwarding speed (printing speed) of the printing platen roller 33 is generally fixed at the same speed as the forwarding speed (activation speed) of the platen roller 53 for thermal activation.

According to thus-constituted thermal printer P2, after the adhesion of the heat sensitive adhesive label 60 is developed, the display label, the price label or advertisement label as it is, can be attached to a cardboard, a food wrap, a glass bottle, a plastic case, and the like. Therefore, a separator for use in the conventional general stick-on label becomes unnecessary and it is effective in reducing the cost. From a view point of the resource saving and the environmental concerns, it is preferable because any separator that will become wastes after use is not required.

In the printer P2 as shown in FIG. 15, however, when the cutter unit 40 performs the cutting operation, it is necessary to stop the forwarding of the heat sensitive adhesive label 60 for the time taken for the vertical movement of the movable blade 41 (for example, 0.4 sec). Namely, the cutter unit 40 performs the cutting operation in a state of stopping the rotation of the printing platen roller 33, the drawing rollers 54, and the platen roller 53 for thermal activation.

Therefore, when the length of a label is longer than the distance from the cut position of the cutter unit 40 to the heater element 51 of the thermal head 52 for thermal activation, the forwarding is stopped in a state of pinching the heat sensitive adhesive label 60 between the thermal head 52 for thermal activation and the platen roller 53 for thermal activation.

As a result, the heat sensitive adhesive layer having the adhesion may be attached to the thermal head 52 for thermal activation (heater element 51) and the label cannot be forwarded smoothly even if the forwarding resumes, thereby causing a disadvantage such as a so-called paper jam or a failure in forwarding. Further, there is a problem of transmitting the heat from the heater element 51 even to the printable layer (heat sensitive coloring layer) of the heat sensitive adhesive label from which the color may run.

In this case, if the label is discharged, since the appearance of the label is ugly, it cannot be used as the stick-on label. Further, if it is fixedly attached, there may be a case of stopping the processing of the printer for the maintenance. Thus, the printer P2 of FIG. 15 is defective in improving the manufacturing efficiency of the stick-on label.

SUMMARY OF THE INVENTION

An object of the present invention is to provide a forwarding and cutting method and a printer capable of cutting a heat sensitive adhesive sheet to a predetermined length, without stopping the forwarding of the sheet in a state of the heat sensitive adhesive sheet being pinched between the heating means for thermal activation and the platen roller arranged on the side opposite to the heating means.

The invention is a forwarding and cutting method of a heat sensitive adhesive sheet in a printer comprising a printing device including printing means for printing on a printable layer of a heat sensitive adhesive sheet formed by the printable layer on one surface of a sheet-shaped substrate and a heat sensitive adhesive layer on the other surface thereof and first forwarding means for forwarding the heat sensitive adhesive sheet in a predetermined direction, a cutter provided in the posterior stage to the printing device, for cutting the heat sensitive adhesive sheet to a predetermined length, and a thermal activating means including heating means provided in the posterior stage to the cutter, for heating the heat sensitive adhesive layer and second forwarding device for forwarding the heat sensitive adhesive sheet in a predetermined direction, the method in which after temporarily loosening the sheet between the cutter and the thermal activating device according to a speed control of the first forwarding means and the second forwarding means, an operation of the first forwarding means is stopped so as to cut the sheet with the cutter.

Here, the sheet length temporarily loosened is made longer than the sheet length forwarded by the second forwarding means while the cutter is cutting the sheet. For example, when the forwarding speed of the second forwarding means (platen roller for thermal activation and drawing rollers) is 100 mm/sec. and the cutting hour by the cutter is 0.4 sec., since 40 mm of the sheet is forwarded by the second forwarding means during 0.4 sec., the sheet of 40 mm and longer is loosened.

Thus, since the sheet can be cut by the cutter while forwarding the heat sensitive adhesive sheet by the second forwarding means or before the leading end of the heat sensitive adhesive sheet arrives at the heating means, it is possible to dissolve a disadvantage such as a paper jam caused by attaching the heat sensitive adhesive sheet to the heating means and it is not necessary to do a useless maintenance such as discharging a label having caused the paper jame. Accordingly, the manufacturing efficiency of the stick-on label can be improved extremely.

More specifically, a predetermined length of the sheet can be temporarily loosened between the cutter and the thermal activating device by making a forwarding speed of the second forwarding means slower than a forwarding speed of the first forwarding means. Heretofore, although it is general to forward the heat sensitive adhesive sheet without loosening it, by making identical the forwarding speed of the first forwarding means and the forwarding speed of the second forwarding means, the invention intentionally makes different the forwarding speed (printing speed) of the first forwarding means and the forwarding speed (activating speed) of the second forwarding means. Thus, the predetermined length of the heat sensitive adhesive sheet can be loosened at ease.

When the second forwarding means is formed by the platen roller for thermal activation arranged opposite to the heating means, the predetermined length of the sheet may be temporarily loosened between the cutter and the thermal activating device according to a speed control of the first forwarding means and the platen roller for thermal activation. When a pair of drawing rollers bringing into contact with each other is provided in the prior stage of the platen roller, the predetermined length of the sheet may be temporarily loosened between the cutter and the thermal activating device according to a speed control of the first forwarding means and the drawing rollers. Thus, the heat sensitive adhesive sheet can be loosened at ease without any complicated speed control.

The predetermined length of the sheet may be temporarily loosened between the cutter and the thermal activating device, by stopping the rotation of the drawing rollers once at a time when the leading end of the heat sensitive adhesive sheet arrives at a space between the drawing rollers and the platen roller for thermal activation. Thus, the heat sensitive adhesive sheet can be loosened at ease without any complicated speed control.

The printer according to the invention is a printer capable of realizing the cutting and forwarding method for a heat sensitive adhesive sheet as mentioned above, comprising at least a printing device including printing means for printing on a printable layer of a heat sensitive adhesive sheet formed by the printable layer on one surface of a sheet-shaped substrate and a heat sensitive adhesive layer on the other surface thereof and first forwarding means for forwarding the heat sensitive adhesive sheet in a predetermined direction, a cutter provided in the posterior stage to the printing device, for cutting the heat sensitive adhesive sheet to a predetermined length, a thermal activating device including heating means provided in the posterior stage to the cutter, for heating the heat sensitive adhesive layer and second forwarding means for forwarding the heat sensitive adhesive sheet in a predetermined direction, and a controller capable of individually controlling forwarding speeds of the first forwarding means and the second forwarding means, and further comprising a storage sheet portion having a space capable of loosening a predetermined length of the heat sensitive adhesive sheet between the cutter and the thermal activating device, and sheet guiding means for loosening the heat sensitive adhesive sheet in a predetermined direction.

Thus, a forwarding failure caused by tangle of a loosened sheet can be prevented by providing the storage sheet portion.

Specifically, the sheet guiding means is formed by a first guide provided substantially in parallel with the forwarded heat sensitive adhesive sheet and a second guide provided opposite to the first guide across the forwarded heat sensitive adhesive sheet, and the second guide is provided with a guide portion formed for helping the heat sensitive adhesive sheet loosen in the storage sheet portion. For example, the first guide may be a plate-shaped guide provided on a passage from the cutter to the thermal activating device, and the second guide may be a pair of guides bent at substantially right angles opposite to the first guide, which are provided in the discharge portion of the cutter and the insertion portion of the thermal activating device. Thus, since too much stress to the sheet can be prevented, the sheet can be prevented from being wrinkled owing to the looseness and the sheet can be loosened in the storage sheet portion assuredly. An open portion formed between the pair of the guides (the second guides) may be served as the storage sheet portion.

The sheet guiding means may include discharging direction changing means for specifying a sheet discharging direction from the printing device and inserting direction changing means for specifying a sheet inserting direction to the thermal activating device. Thus, without providing the guide, the sheet can be loosened to some degree in a desired direction.

When the printing means is a printing thermal head for printing by heating a printable layer of the heat sensitive adhesive sheet and the first forwarding means is a printing platen roller arranged opposite to the printing thermal head, the discharging direction changing means is formed by the printing thermal head and the printing platen roller, and the printing thermal head and the printing platen roller are arranged in such a way that a tangent passing through a junction point of the both is inclined against a straight line connecting a discharge point of the printing device and an insertion point of the thermal activating device, by a predetermined angle.

For example, when the second guide is opened upwardly (the storage sheet portion is provided upward in the forwarding direction), the printing thermal head and the printing platen roller are arranged in such a way that the tangent passing through the junction point of the both can be inclined against the straight line connecting the discharge point of the printing device and the insertion point of the thermal activating device by 0 to 90°. Thus, it is not necessary to provide with a new part as the discharging direction changing means, thereby preventing from increasing the manufacturing cost of the printer and enlarging the size of the device.

When the heating means is a thermal head for thermal activation for thermal-activating the heat sensitive adhesive layer of the heat sensitive adhesive sheet by heating the above layer and the second forwarding means is a platen roller for thermal activation arranged opposite to the thermal head of thermal activation, the inserting direction changing means is formed by the thermal head for thermal activation and the platen roller for thermal activation, and the thermal head for thermal activation and the platen roller for thermal activation are arranged in such a way that a tangent passing through a junction point of the both can be inclined against the straight line connecting the discharge point of the printing device and the insertion point of the thermal activating device, by a predetermined angle. For example, when the second guide is opened upwardly, the thermal head for thermal activation and the platen roller for thermal activation are arranged in such a way that the tangent direction in their contact point can be inclined against the horizontal direction by 0 to 90°. Thus, it is not necessary to provide with a new part as the inserting direction changing means, thereby preventing from increasing the manufacturing cost of the printer and enlarging the size of the device.

When the second forwarding means is a pair of drawing rollers bringing contact with each other, which are provided in a sheet inserting portion of the thermal activating device, the inserting direction changing means may be formed by the pair of the drawing rollers, and the pair of the drawing rollers may be arranged in such a way that a tangent passing through the junction point of the both can be inclined against the straight line connecting the discharge point of the printing device and the insertion point of the thermal activating device, by a predetermined angle.

Further, it is preferable to form the printing device, the cutter, and the thermal activating device in a way capable of changing each mutual distance. Heretofore, since the positions of the respective devices are fixed, the sheet is cut for a length from the cutter to (the drawing rollers of) the thermal activating device at the shortest. According to the above structure, however, it is possible to cope with the manufacture of a shorter sheet and cut the sheet to a desired length.

In this case, for example, a guide unit such as a rail may be provided in the forwarding direction of the heat sensitive adhesive sheet, to make the cutter and the thermal activating device slidable in the forwarding direction of the sheet, thereby adjusting the mutual distance. Further, the mutual distance can be adjusted also by forming the cutter and the thermal activating device in a movable way in a vertical direction.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Hereinafter, preferred embodiments of the invention will be described in details with reference to the drawings.

Figure 1:
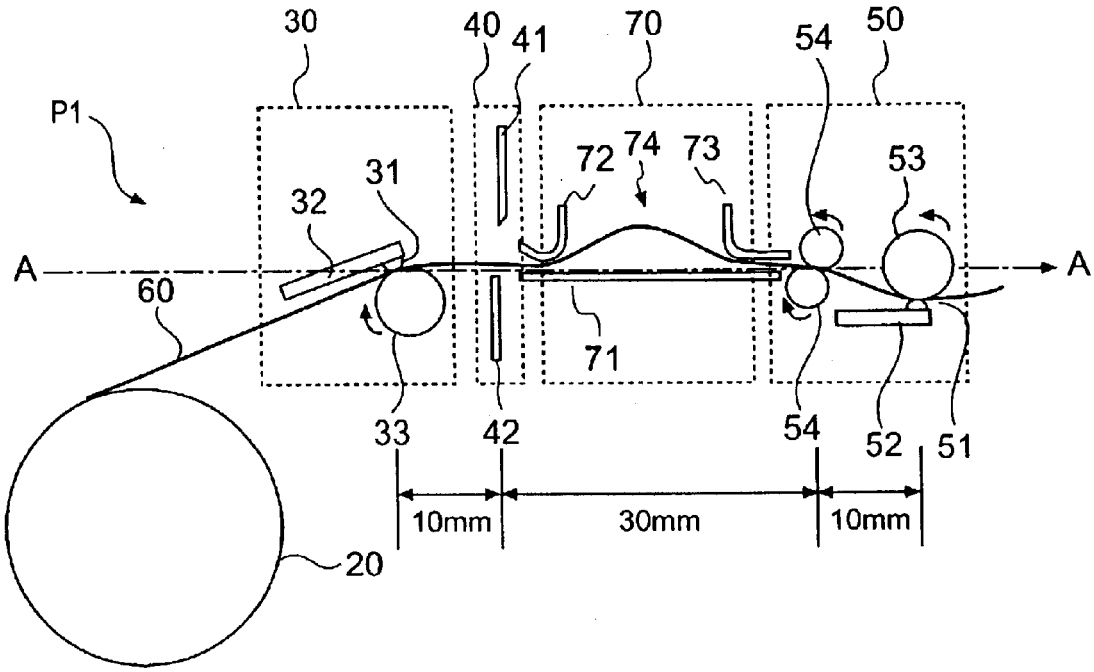
FIG. 1 is a schematic view showing the structural example of the thermal printer P1 according to the invention.

FIG. 1 is a schematic view showing the structure of a thermal printer P1 for a heat sensitive adhesive sheet according to the invention. The thermal printer P1 comprises a roll case unit 20 for holding a tape-shaped heat sensitive adhesive label 60 reeled like a roll, a printing unit 30 for printing the heat sensitive adhesive label 60, a cutter unit 40 for cutting the heat sensitive adhesive label 60 to a predetermined length, a thermal activating unit 50 as the thermal activating device for thermal-activating the heat sensitive adhesive layer of the heat sensitive adhesive label 60, a guide unit 70 as sheet guiding means for guiding the heat sensitive adhesive label 60 from the cutter unit 40 to the thermal activating unit 50 and a storage sheet portion, and the like.

The heat sensitive adhesive label 60 used in this embodiment is not limited, but, for example, it has constitution that an insulating layer and a heat sensitive coloring layer (printable layer) are formed on the top surface of the label substrate and that a heat sensitive adhesive layer with the heat sensitive adhesive applied and dried is formed on the back surface thereof. The heat sensitive adhesive layer is formed by a heat sensitive adhesive mainly made from the thermoplastic resin, the solid elasticizer, and the like. The heat sensitive adhesive sheet 60 maybe one without having the insulating layer, or one having a protective layer or a color printing layer (previously printed layer) on the top surface of the heat sensitive coloring layer.

The printing unit 30 comprises a printing thermal head 32 including a plurality of heater elements formed by a plurality of comparatively small resistive elements which are aligned in the width direction in a way capable of dot printing, and a printing platen roller 33 pushed toward the printing thermal head 32, and the like. The heater elements 31 have the same structure as that of the printing head of a well-known thermal printer, formed by providing a crystal glass protective film on the surfaces of the heat resistive elements formed on the ceramic substrate by a thin film technique, and therefore the detailed description is omitted here.

The printing unit 30 is provided with a driving system, not illustrated, consisting of, for example, an electric motor, a gear series, and the like, for rotating the printing platen roller 33, and by rotating the printing platen roller 33 in a predetermined direction according to this driving system, the heat sensitive adhesive label 60 is drawn out from the roll, and the drawn heat sensitive adhesive label 60 is forwarded in the predetermined direction while being printed by the printing thermal head 32. In FIG. 1, the printing platen roller 33 is rotated clockwise and the heat sensitive adhesive label 60 is forwarded to the right side. The printing unit 30 is provided with pressing means, not illustrated, consisting of, for example, a coil spring, a flat spring, and the like, and the elastic force of this pressing means is adopted to push the printing platen roller 33 toward the thermal head 32. At this time, by keeping the rotation axis of the printing platen roller 33 and the arrangement direction of the heater elements 31 in parallel, they can be in contact with the heat sensitive adhesive label 60 uniformly in the whole width direction.

Figure 3:
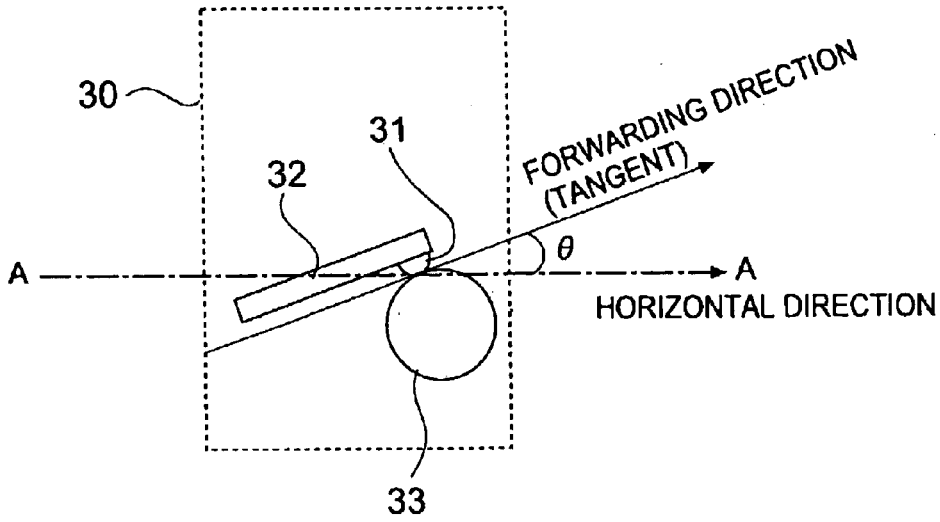
FIG. 3 is an enlarged view of the printing unit 30.

Further, in the printing unit 30, the printing thermal head 32 (heater elements 31) and the printing platen roller 33 work as forwarding direction changing means for specifying the forwarding direction of the sheet. Namely, the printing thermal head 32 (heater elements 31) and the printing platen roller 33 are arranged in such a way that a tangent (a forwarding direction) passing through the junction point of the both is inclined by a predetermined angle θ against a straight line A—A connecting a sheet discharge point of the printing unit 30 (the junction point of the printing platen roller 3 and the printing thermal head 32) and a sheet inserting point of the thermal activating unit 50 (the junction point of a pair of drawing rollers 54) (refer to FIG. 3).

Here, the inclination θ is experimentally determined at an optimum angle. When determining the angle, it is preferable to consider the shape of a second guide 72. When loosening the heat sensitive adhesive sheet 60 upwardly, it is preferable to fix θ=20°, for example.

The cutter unit 40 is in order to cut the heat sensitive adhesive label 60 having been printed by the printing unit 30 to a proper length, and it is formed by a movable blade 41 operated by a driving source (not illustrated) such as an electric motor, a fixed blade 42 fixed on the side opposite to the movable blade, and the like.

The guide unit 70 is formed by a plate-shaped guide (first guide) 71 provided on a passage from the cutter unit 40 to the thermal activating unit 50 and guides 72 and 73 bent upward at a substantially right angle which are respectively provided in the discharge portion of the cutter unit 40 and in the inserting portion of the thermal activating unit 50. The space between the second guides 72 and 73 is opened, serving as a storage label portion 74 capable of temporarily loosening a label to a predetermined degree.

The second guides 72 and 73 may be formed by one member with a concave portion formed on the upper side as the storage sheet portion, or the first guide 71 and the second guides 72 and 73 may be provided upside down. In this case, the storage label portion 74 is formed on the lower side in the forwarding direction.

A label is loosened by controlling the rotation speed of the printing platen roller 33 and the drawing rollers 54 (or platen roller 53 for thermal activation) as described later.

The thermal activating unit 50 comprises the thermal head 52 for thermal activation as the heating means having a heater element 51, the platen roller 53 for thermal activation as the forwarding means for forwarding the heat sensitive adhesive label 60, a pair of drawing rollers 54, rotated by, for example, a driving source, not illustrated, for drawing the heat sensitive adhesive label 60 supplied from the side of the printing unit 30 into the space between the thermal head 52 for thermal activation and the platen roller 53 for thermal activation, and the like.

The thermal head 52 for thermal activation has the same structure as that of the printing thermal head 32, in this embodiment, and more specifically, the thermal head having the same structure as that of the printing head of a well-known thermal printer is used, which is formed by providing a crystal glass protective film on the surfaces of a plurality of heater resistive elements formed on a ceramic substrate according to the thin film technique. By using the thermal head 52 for thermal activation having the same structure as that of the printing thermal head 32, the part can be standardized and the cost can be reduced. The heater element 51 of the thermal head 52 for thermal activation, however, does not have to be divided by the dot unit, differently from the heater element 31 of the printing head 32, but it may be a continuous resistive element.

The thermal activating unit 50 has a driving system including, for example, an electric motor, a gear series, and the like for rotating the platen roller 53 for thermal activation, and the platen roller 53 for thermal activation is rotated in an opposite direction to the printing platen roller 33 (counterclockwise in FIG. 1) according to the driving system, so as to forward the heat sensitive adhesive label 60 in a predetermined direction (the right side in FIG. 1). The thermal activating unit 50 has the pressing means (for example, a coil spring and a flat spring) for pushing the platen roller 53 for thermal activation toward the thermal head 52. By keeping the rotation axis of the platen roller 53 for thermal activation and the arrangement direction of the heater element 51 in parallel, they can be in contact with the heat sensitive adhesive label 60 uniformly in the whole width direction.

Figure 4:
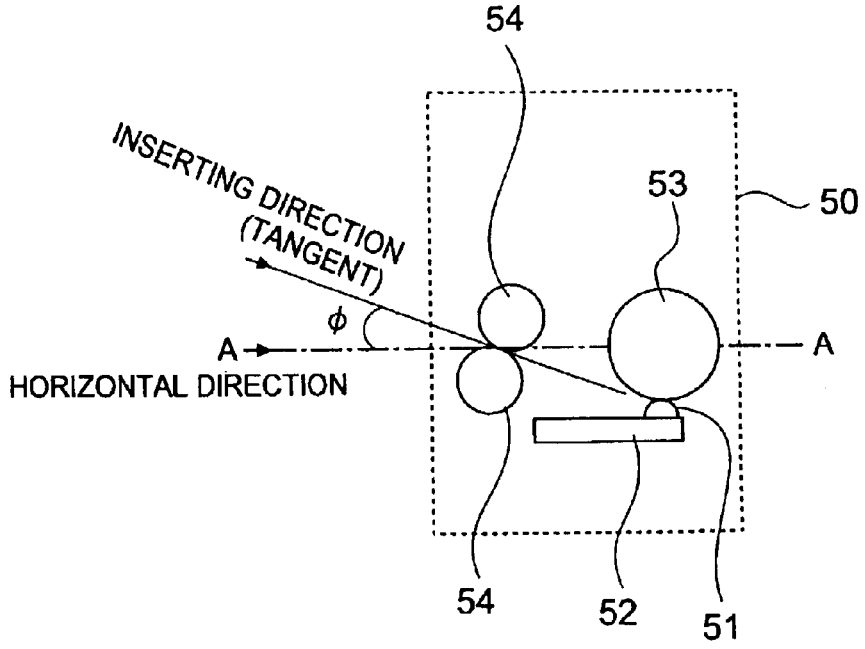
FIG. 4 is an enlarged view of the thermal activating unit 50.
Figure 5A:
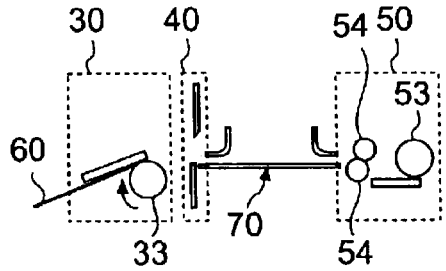
FIG. 5 is a view for use in describing the forwarding state of the heat sensitive adhesive label 60 according to the first embodiment.
Figure 5B:
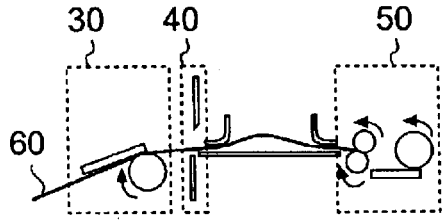
Figure 5C:
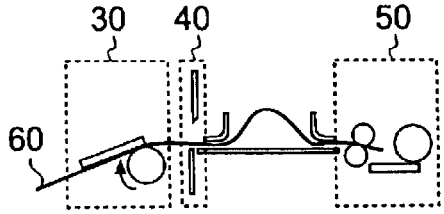
Figure 5D:
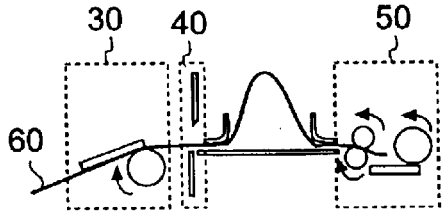
Figure 5E:
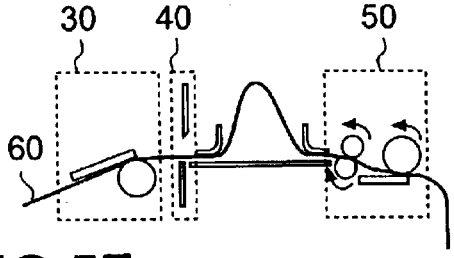
Figure 5F:
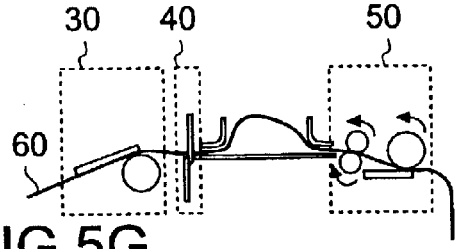
Figure 5G:
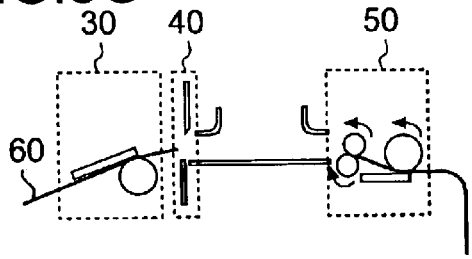

In the thermal activating unit 50, a pair of the drawing rollers 54 works as the inserting direction changing means for specifying the inserting direction of the sheet. Namely, the drawing rollers 54 are arranged in such a way that a tangent (inserting direction) passing through the junction point of the both is inclined by a predetermined angle $\phi$ against a straight line A—A (refer to FIG. 4). In the case of the structure having no drawing roller 54, the thermal head 52 for thermal activation (heater element 51) and the platen roller 53 for thermal activation may serve as the inserting direction changing means.

Here, the inclination $\phi$ is experimentally determined at an optimum angle. When determining the angle, it is preferable to consider the shape of the second guide 73. When loosening the heat sensitive adhesive sheet 60 upwardly, it is preferable to fix $\phi=20°$, for example.

Figure 2:
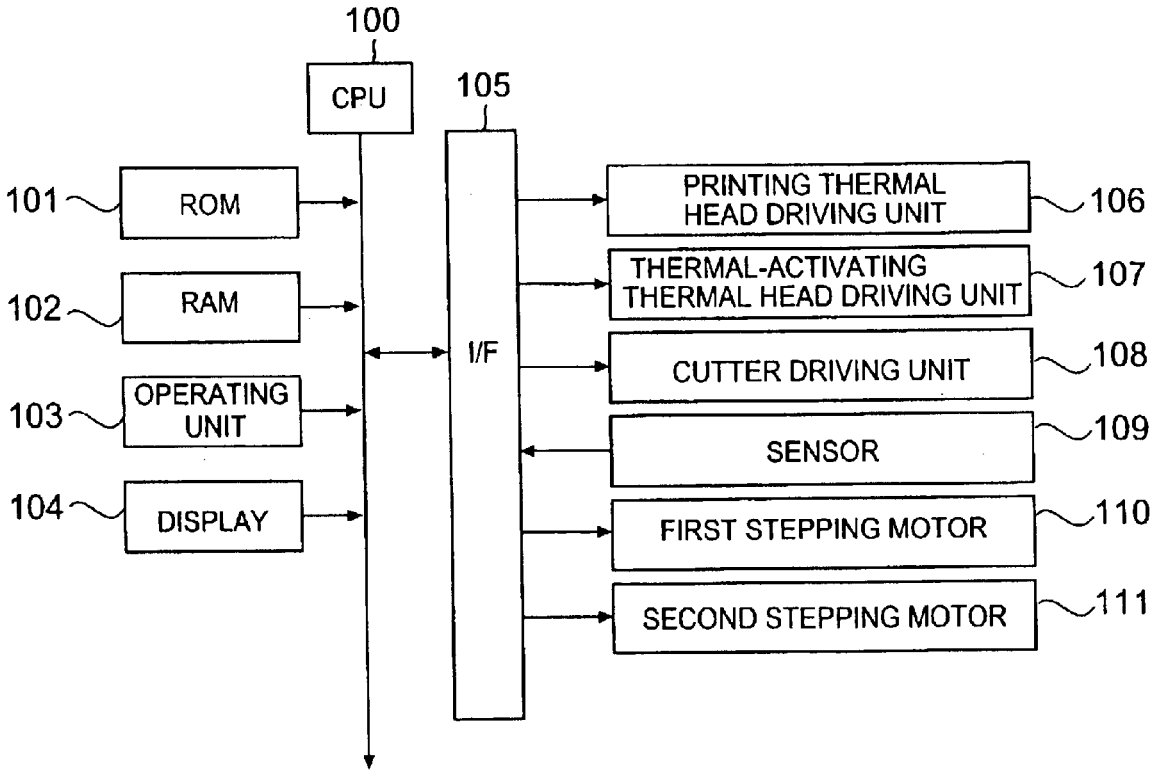
FIG. 2 is a block diagram showing the structural example of the control system of the thermal printer.

FIG. 2 is a control block diagram of the thermal printer P1. The controlling unit of this thermal printer P1 comprises a CPU 100 as a controller for managing the controlling unit, a ROM 101 for storing the control program and the like executed by the CPU 100, a RAM 102 for storing various printing formats and the like, an operating unit 103 for receiving, setting, or calling the printing data and the printing format data, etc., a display 104 for displaying the printing data and the like, an interface 105 for performing the input/output of the data between the controlling unit and the driving devices, a driving circuit 106 for driving the printing thermal head 32, a driving circuit 107 for driving the thermal head 52 for thermal activation, a driving circuit 108 for driving the movable blade 41 for cutting the heat sensitive adhesive label 60, a sensor 109 for detecting the heat sensitive adhesive label, a first stepping motor 110 for driving the printing platen roller 33, a second stepping motor 111 for driving the platen roller 53 for thermal activation and the drawing rollers 54, and the like.

According to the control signal sent from the CPU 100, the printing unit 30 performs a desired printing, the cutter unit 40 performs the cutting operation at a predetermined timing, and the thermal activating unit 50 performs the activation of the heat sensitive adhesive layer 64.

The CPU 100 is designed to be able to separately send a control signal to the first stepping motor 110 and the second stepping motor 111. Thus, the rotation speeds of the rollers 33, 53, and 54 driven by the respective stepping motors, namely the forwarding speed of the heat sensitive adhesive label 60 can be controlled independently.

The respective driving sources (stepping motors) of the roller 53 for thermal activation and the drawing rollers 54 can be separately provided, in a way capable of being controlled independently.

The sensor 109 is provided, for example, in the front stage of the thermal activating unit 50, and according to the detection of the leading end of the heat sensitive adhesive label 60 by this sensor 109, the driving of the drawing rollers 54 and the platen roller 53 for thermal activation starts. According to the detection of the trailing end of the heat sensitive adhesive label 60 by this sensor 109, the driving of the drawing rollers 54 and the platen roller 53 for thermal activation stops and the printing, forwarding, and thermal activation of the next heat sensitive adhesive label is performed.

A control method of the forwarding speed for loosening the heat sensitive adhesive label between the cutter unit 40 and the thermal activating unit 50 will be described with reference to FIGS. 5 to 14.

In the embodiment, the distance from the printing platen roller 33 (printing thermal head 32) to the movable blade 41 is defined as 10 mm, the distance from the movable blade 41 to the drawing rollers 54 is defined as 30 mm, and the distance from the drawing rollers 54 to the platen roller 53 for thermal activation (thermal head 52 for thermal activation) is defined as 10 mm. The driving hour of the movable blade 41 taken for cutting a label is defined as 0.4 sec. and the label length is defined as 200 mm.

The forwarding speed (printing speed) by the printing platen roller 33 can be varied to 200 mm/sec. or 100 mm/sec. and the forwarding speed (activation speed) by the platen roller 53 for thermal activation is fixed at 100 mm/sec. in consideration of the thermal activation time of the heat sensitive adhesive layer. The forwarding speed by the drawing rollers 54 can be varied to one of 100 mm/sec., 20 mm/sec., and 5 mm/sec.

Figure 6:
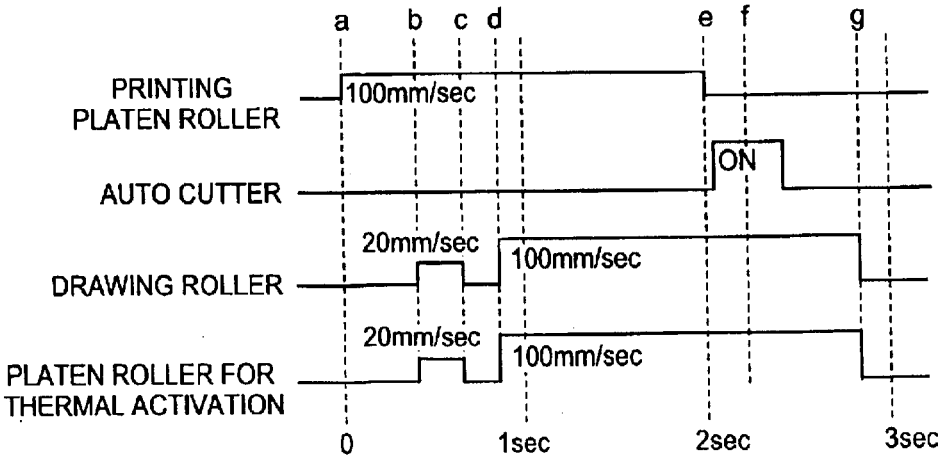
FIG. 6 is a timing chart showing the driving states of the printing platen roller 33, the movable blade 41, the drawing rollers 54, and the platen roller for thermal activation 53 according to the first embodiment.
Figure 7A:
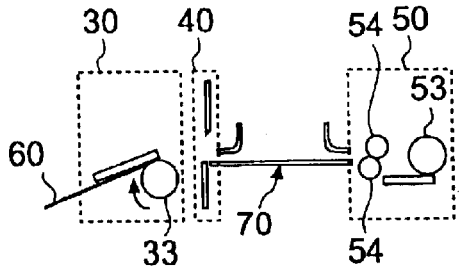
FIG. 7 is a view for use in describing the forwarding state of the heat sensitive adhesive label 60 according to the second embodiment.
Figure 7D:
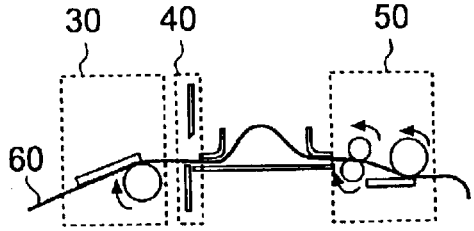
Figure 7B:
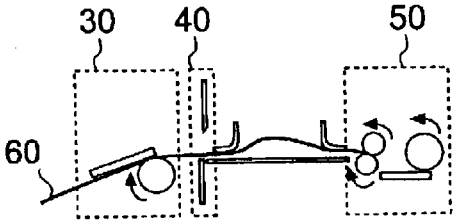
Figure 7E:
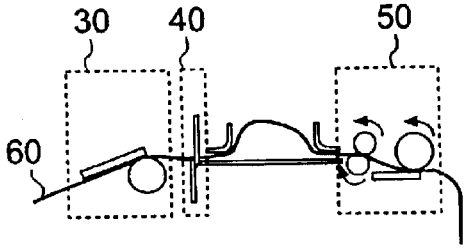
Figure 7C:
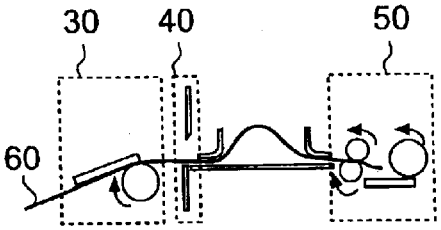
Figure 7F:
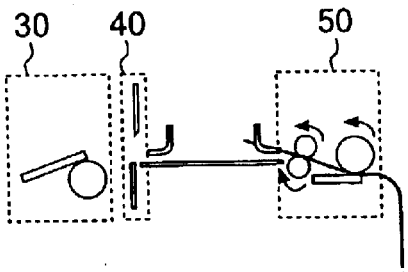

A first embodiment of a speed controlling method is a controlling method of loosening a label by stopping the rotation of the drawing rollers 54 when the leading end of the heat sensitive adhesive label 60 comes between the drawing rollers 54 and the platen roller 53 for thermal activation, in the thermal printer P1. FIG. 5 is a view for use in describing the forwarding state of the heat sensitive adhesive label 60, and FIG. 6 is a timing chart showing the driving state of the printing platen roller 33, the movable blade 41, the drawing rollers 54, and the platen roller 53 for thermal activation. The reference marks a to g attached to the top portion of the timing chart of FIG. 6 correspond to the respective states (a) to (g) of FIG. 5.

The heat sensitive adhesive label 60 is drawn at 100 mm/sec., according to the rotation of the printing platen roller 33, and printed on the printable layer (heat sensitive coloring layer) by the printing thermal head 32 (the reference mark a in FIG. 6). The heat sensitive adhesive label 60 is transferred from the printing unit 30 at the predetermined angle θ according to the rotation of the printing platen roller 33 and forwarded to the cutter unit 40. Then, the label is forwarded along the first guide 71 by its own weight and after 0.4 sec., it arrives at the thermal activating unit 50 (drawing rollers 54). At the same time, according to the rotation of the drawing rollers 54, the heat sensitive adhesive label 60 is forwarded at 20 mm/sec. (the reference mark b in FIG. 6). Since the drawing rollers 54 and the platen roller 53 for thermal activation are driven by the same driving source (the second stepping motor 111), the driving timings of the drawing rollers 54 and the platen roller 53 for thermal activation are the same in FIG. 6. This is the same also in FIG. 8, FIG. 10, and FIG. 12 described later.

After 0.25 sec., namely, when the leading end of the label arrives at the space between the drawing rollers 54 and the platen roller 53 for thermal activation after the heat sensitive adhesive label 60 is forwarded from the drawing rollers 54 by 5 mm, the rotation of the drawing rollers 54 (and the platen roller 53 for thermal activation) is stopped (the reference mark c in FIG. 6). Thereafter, since the drawing rollers 54 are not driven, the leading end of the heat sensitive adhesive label 60 is not forwarded, but the label is forwarded from the printing unit 30 by the printing platen roller 33, thereby generating the looseness.

At this time, since the heat sensitive adhesive label 60 is discharged from the forwarding direction changing means (printing platen roller 33 and printing thermal head 32) and inserted into the inserting direction changing means (a pair of the drawing rollers 54) at a predetermined angle, the direction of loosening the label is determined depending on the inclination (upward in FIG. 5). Since the heat sensitive adhesive label 60 is loosened in a manner of rising up in the storage label portion 74, according to the function of the second guides 72 and 73, it does not cause too much stress to the label. Accordingly, even if the heat sensitive adhesive label 60 is loosened, the appearance of the label can be prevented from being damaged because of a wrinkle produced in the label.

Next, after 0.2 sec., the rotation of the drawing rollers 54 (and the platen roller 53 for thermal activation) is resumed and the heat sensitive adhesive label 60 is forwarded at 100 mm/sec. (the reference mark d in FIG. 6). Thereafter, though the heat sensitive adhesive label 60 is forwarded also by the platen roller 53 for thermal activation, there is no difference between the forwarding speed of the drawing rollers 54 and that of the platen roller 53 for thermal activation because they are driven by the same driving source, and therefore, there will never cause a looseness and a useless tensile force between the drawing rollers 54 and the platen roller 53 for thermal activation.

At this point, since the label length forwarded by the printing platen roller 33 is 85 mm, the label length forwarded by the drawing rollers 54 is 5 mm, and the distance between the printing platen roller 33 and the drawing rollers 54 is 40 mm, a looseness of about 40 mm (=85−5−40) is produced. Thanks to this looseness of the label, the cutting operation of the label described later can be performed without stopping the rotation of the drawing rollers 54 and the roller 53 for thermal activation.

Thereafter, the heat sensitive adhesive label 60 is forwarded at 100 mm/sec., according to the rotation of the three rollers 33, 54, and 53. Therefore, the looseness amount of the label is not changed. After finishing a predetermined printing (200 mm), the rotation of the printing platen roller 33 is stopped (the reference mark e in FIG. 6). Thereafter, the movable blade 41 is driven for a predetermined hour (0.4 sec.), thereby cutting the heat sensitive adhesive label 60 (the reference mark f in FIG. 6). At this time, the rotation of the platen roller 53 for thermal activation is continued and the heat sensitive adhesive label 60 is kept forwarding. Since the label length forwarded by the drawing rollers 54 while the movable blade 41 is driving (0.4 sec.) is 40 mm, the cut is finished while the loosened label is being forwarded.

When the trailing end of the heat sensitive adhesive label 60 has passed through the drawing rollers 54, the rotation of the drawing rollers 54 is stopped (the reference mark g in FIG. 6), and the heat sensitive adhesive label 60 is forwarded by the platen roller 53 for thermal activation as it is.

As mentioned above, according to the thermal printer P1 of the embodiment, since the heat sensitive adhesive label 60 can be cut by the cutter unit 40, without stopping the forwarding of the heat sensitive adhesive label in the thermal activating unit 50, it is possible to prevent from a paper jam and a forwarding failure because of the heat sensitive adhesive layer of the heat sensitive adhesive label 60 attached to the thermal head 52 for thermal activation (heater element 51).

Further, according to the above-mentioned thermal printer P1, since the heater element 51 of the thermal head 52 for thermal activation is in contact with the heat sensitive adhesive layer 64 of the heat sensitive adhesive label 60, the heater element 51 can transmit heat directly to the heat sensitive adhesive layer 64 and the thermal activation can be performed efficiently. Further, since it is only during the energization that the heater element 51 of the thermal head 52 can perform the thermal activation, emitting heat, the energy consumption for the thermal activation can be lessened.

Figure 8:
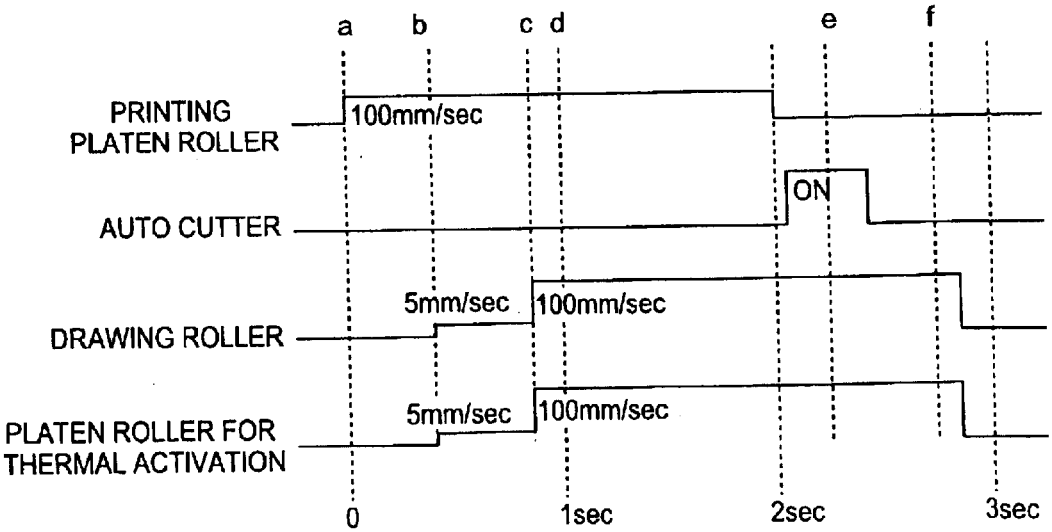
FIG. 8 is a timing chart showing the driving states of the printing platen roller 33, the movable blade 41, the drawing rollers 54, and the platen roller 53 for thermal activation according to the second embodiment.
Figure 9A:
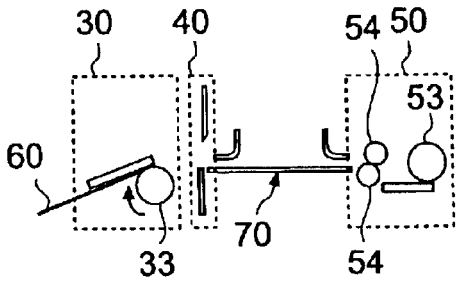
FIG. 9 is a view for use in describing the forwarding state of the heat sensitive adhesive label 60 according to the third embodiment.
Figure 9B:
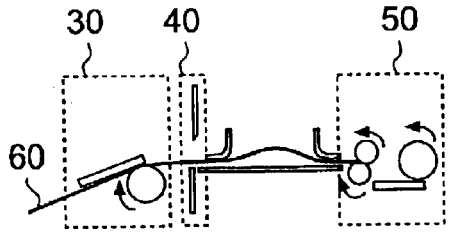
Figure 9C:
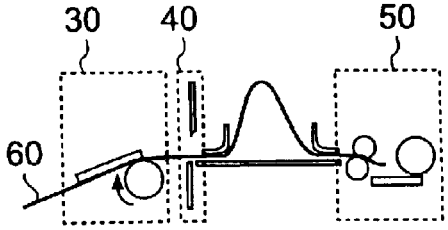
Figure 9D:
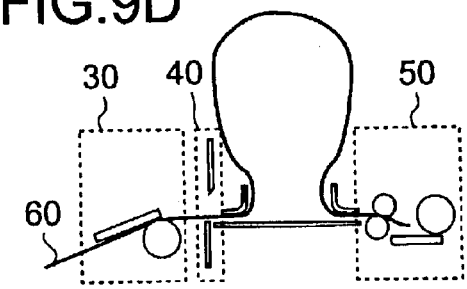
Figure 9E:
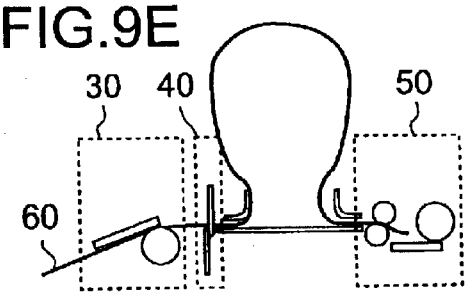
Figure 9F:
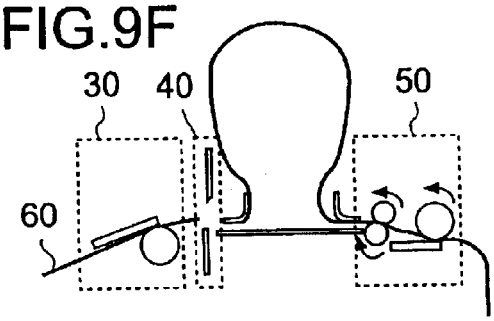

A second embodiment of the speed controlling method is a controlling method in the case of loosening the heat sensitive adhesive label 60 by making the forwarding speed by the drawing rollers 54 slower than the forwarding speed by the printing platen roller 33, in the thermal printer P1. FIG. 7 is a view for use in describing the forwarding state of the heat sensitive adhesive label 60, and FIG. 8 is a timing chart corresponding to the respective states of FIG. 7.

In the first embodiment, the rotation of the drawing rollers 54 is stopped so as to loosen the label when the leading end of the heat sensitive adhesive label 60 arrives at the space between the drawing rollers 54 and the platen roller 53 for thermal activation, while, this embodiment is different from the above embodiment in that the label is loosened without stopping the drawing rollers 54. Further, since it is necessary to loosen a predetermined length of the label by the time the leading end of the heat sensitive adhesive label 60 arrives at the platen roller 53 for thermal activation, in this embodiment, the initial forwarding speed is defined at 5 mm/sec., according to the rotation of the drawing rollers 54.

Namely, as soon as the leading end of the heat sensitive adhesive label 60 arrives at the drawing rollers 54, the drawing rollers 54 starts rotation so to forward the heat sensitive adhesive label 60 at 5 mm/sec., thereby producing the looseness owing to a difference between the forwarding speed of the printing platen roller 33 and that of the drawing rollers 54 (FIGS. 7(*b*) and (*c*)).

Figure 10:
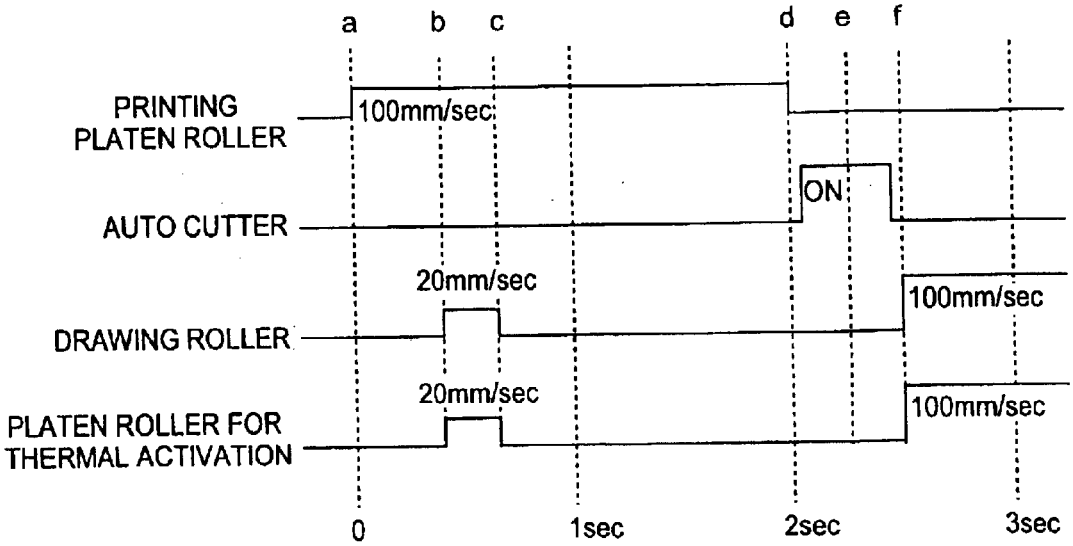
FIG. 10 is a timing chart showing the driving states of the printing platen roller 33, the movable blade 41, the drawing rollers 54, and the platen roller 53 for thermal activation according to the third embodiment.
Figure 11A:
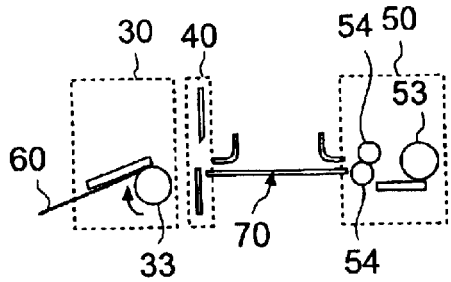
FIG. 11 is a view for use in describing the forwarding state of the heat sensitive adhesive label 60 according to the fourth embodiment.
Figure 11D:
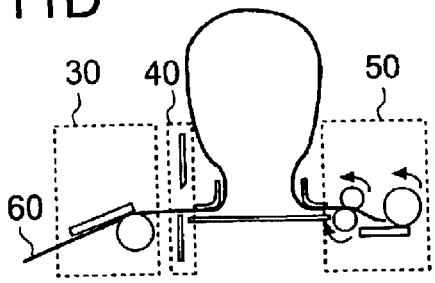
Figure 11B:
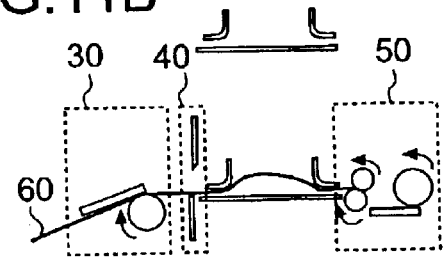
Figure 11E:
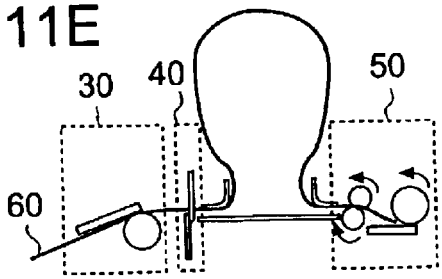
Figure 11C:
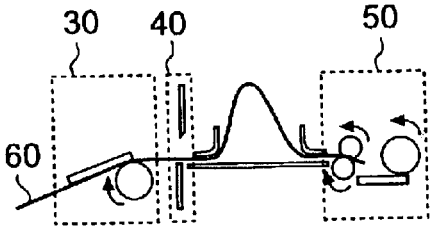
Figure 11F:
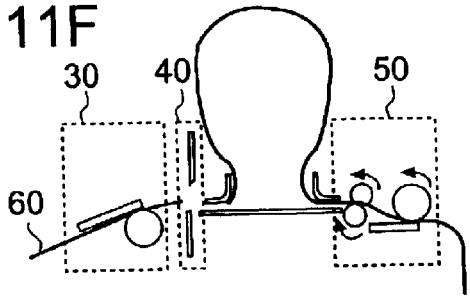

A third embodiment of the speed controlling method is a controlling method of loosening the label by stopping the rotation of the drawing rollers 54 when the leading end of the heat sensitive adhesive label 60 arrives at the space between the drawing rollers 54 and the platen roller 53 for thermal activation, in the thermal printer P1. FIG. 9 is a view for use in describing the forwarding state of the heat sensitive adhesive label 60 and FIG. 10 is a timing chart corresponding to the respective states of FIG. 9.

In the first embodiment, after loosening the label for the predetermined length, the rotation of the drawing rollers 54 is resumed at once (the reference mark d in FIG. 6). While, this embodiment is different from the above in that the rotation of the drawing rollers 54 is resumed after completion of the printing and the label cut (the reference mark f in FIG. 10).

Namely, in the first embodiment, the looseness amount of the label is not varied in the drawings later than FIG. 5(*c*) because the heat sensitive adhesive label 60 is forwarded at 100 mm/sec., according to the rotation of the three rollers. In this embodiment, however, the looseness amount of the heat sensitive adhesive label is increased because the rotation of the drawing rollers 54 is kept in a halt (FIG. 9(*d*)).

Figure 12:
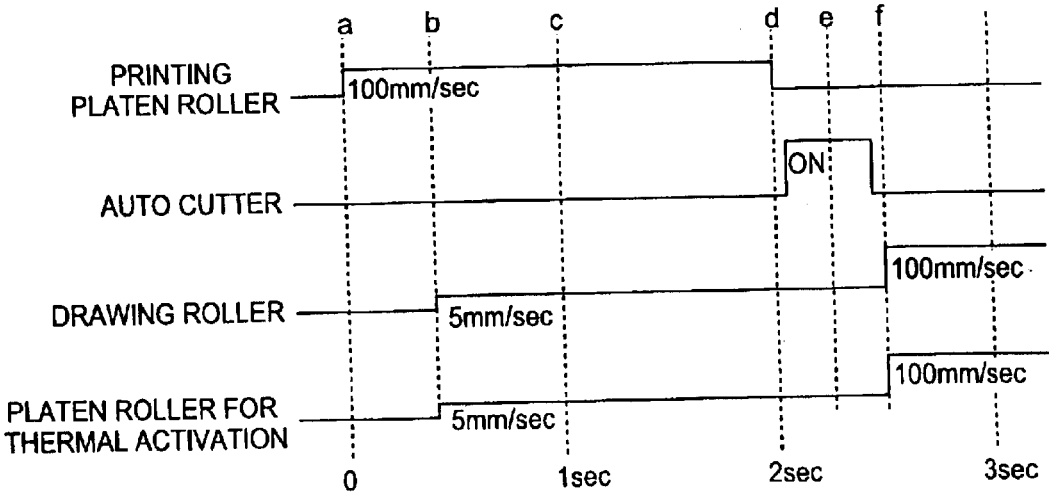
FIG. 12 is a timing chart showing the driving states of the printing platen roller 33, the movable blade 41, the drawing rollers 54, and the platen roller 53 for thermal activation according to the fourth embodiment.
Figure 13A:
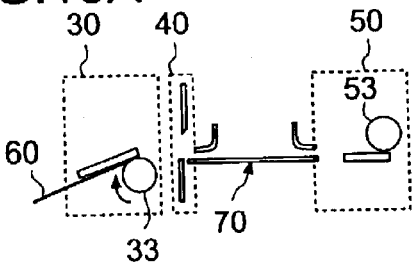
FIG. 13 is a view for use in describing the forwarding state of the heat sensitive adhesive label 60 according to the fifth embodiment.
Figure 13D:
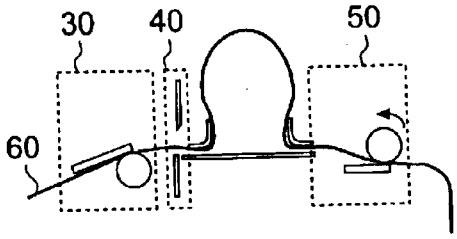
Figure 13B:
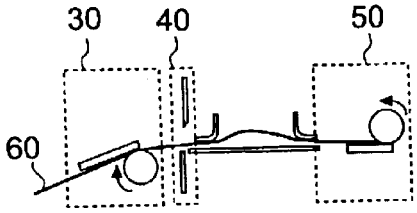
Figure 13E:
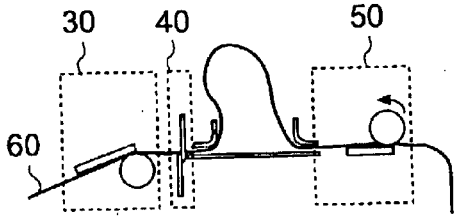
Figure 13C:
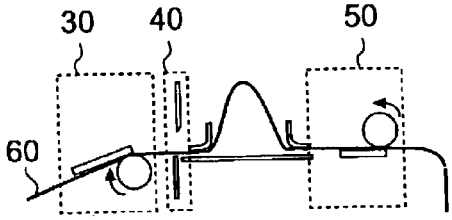
Figure 13F:
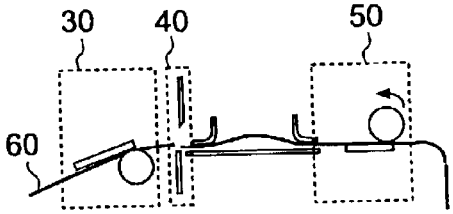

A fourth embodiment of the speed controlling method is a controlling method in the case of loosening the heat sensitive adhesive label 60 by making the forwarding speed by the drawing rollers 54 slower than the forwarding speed by the platen roller 53 for thermal activation, in the thermal printer P1. FIG. 11 is a view for use in describing the forwarding state of the heat sensitive adhesive label 60, and FIG. 12 is a timing chart corresponding to the respective states of FIG. 11.

In the second embodiment, after loosening the label for the predetermined length, the forwarding speed of the drawing rollers 54 is increased at once (the reference mark c in FIG. 8). While, this embodiment is different from the above in that the forwarding speed of the drawing rollers 54 is increased after completion of the printing and the label cut (the reference mark f in FIG. 12).

Namely, in the second embodiment, the looseness amount of the label is not varied in the drawings later than FIG. 7(*c*) because the heat sensitive adhesive label 60 is forwarded at 100 mm/sec., according to the rotation of the three rollers. While, in this embodiment, the looseness amount of the heat sensitive adhesive label is increased because the forwarding speed according to the rotation of the drawing rollers 54 is kept slower (FIG. 11(*d*)).

Since the forwarding speed of the drawing rollers 54 is 5 mm/sec. and much slower than the forwarding speed 100 mm/sec. of the printing platen roller 33, the leading end of the label does not arrive at the platen roller 53 for thermal activation even when the label of 200 mm has been forwarded by the printing platen roller 33 after completion of the predetermined printing. Further, it is preferable to increase the forwarding speed according to the rotation of the drawing rollers just after completion of the label cut by the cutter unit 30 (for example, after 0.25 sec.).

The above first to fourth embodiments are to be concerned with the thermal printer P1 of FIG. 1, and a thermal printer having the structure excluding the drawing rollers 54 from FIG. 1 could loosen the label by adopting the following speed controlling method.

Figure 14:
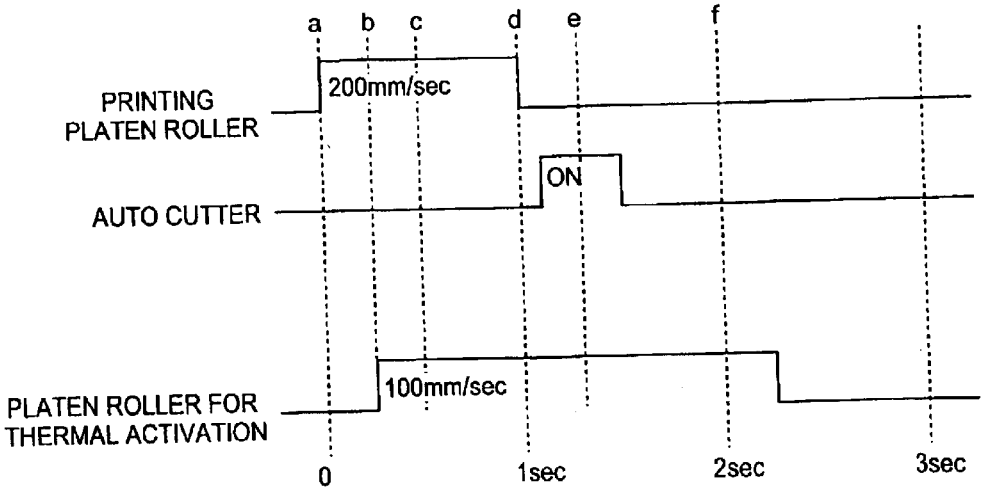
FIG. 14 is a timing chart showing the driving states of the printing platen roller 33, the movable blade 41, and the platen roller 53 for thermal activation according to the fifth embodiment.
Figure 15:
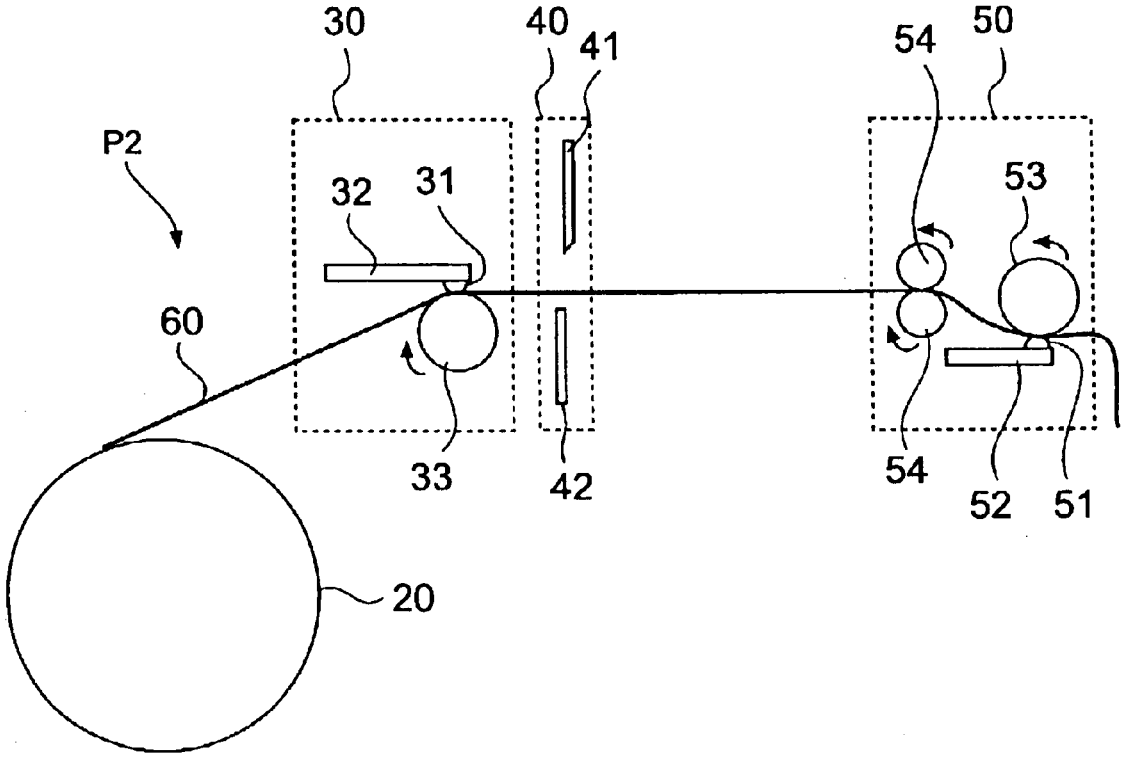
FIG.15 PRIOR ART
FIG. 15 is a schematic view showing the structural example of the conventional thermal printer P2.

A fifth embodiment of the speed controlling method is a controlling method in the case of loosening the heat sensitive adhesive label 60 by making the forwarding speed of the printing platen roller 53 slower than the forwarding speed of the printing platen roller 33, in the thermal printer having no drawing roller 54 in the thermal activating unit 50. FIG. 13 is a view for use in describing the forwarding state of the heat sensitive adhesive label 60, and FIG. 14 is a timing chart showing the driving states of the printing platen roller 33, the movable blade 41, and the platen roller 53 for thermal activation.

In this embodiment, since the forwarding speed of the platen roller 53 for thermal activation is fixed at 100 mm/sec., by consideration of the time taken for the thermal activation of the heat sensitive adhesive layer, the forwarding speed of the printing platen roller 33 is set at 200 mm/sec., thereby producing a difference in speed.

In the printer of FIG. 13 having no drawing roller 54, the thermal head 52 for thermal activation and the platen roller 53 for thermal activation may be adopted as the inserting direction changing means. In this case, they are arranged in such a way that a tangent direction in a contact point of the thermal head 52 for thermal activation and the platen roller 53 for thermal activation is inclined by a predetermined angle against the horizontal direction.

As mentioned above, according to the speed controlling methods described in the above embodiments, it is possible to cut a label without stopping the forwarding with the heat sensitive adhesive label 60 pinched between the platen roller 53, for thermal activation and the thermal head 52 for thermal activation (heater element 51). Accordingly, it is possible to prevent from such a disadvantage as to cause a paper jam because of the heat sensitive adhesive label attached to the thermal head 52 for thermal activation (heater element 51), thereby extremely improving the efficiency in manufacturing a stick-on label.

As mentioned above, although the invention made by the present inventor et al. has been specifically described, according to the embodiments, it is not restricted to the above embodiments, but various modifications are possible without departing from the spirit.

For example, in the above embodiments, although the description has been made in the case of adopting the invention to a thermal-transfer printing device like a thermal printer, it can be adopted to an ink-jet printing method, a laser-printing method, and the like. In this case, it is necessary to use a label with the processing proper to each printing method performed on the printable layer thereof, instead of the heat sensitive printing layer.

When a label is too short to loosen, the rotation of the printing platen roller 33 is stopped after completion of the printing and simultaneously, the rotation of the drawing rollers 54 is stopped so as to cut the label. At this time, it is designed in such a way that the leading end of the label does not arrive at the platen roller 53 for thermal activation. For example, a guide apparatus such as a rail is provided in the forwarding direction of the label, so that the cutter unit 40 and the thermal activating unit 50 can move along the forwarding direction of the label, thereby to adjust the distance there between. Further, the distance may be adjusted by moving the cutter unit 40 and the thermal activating unit 50 in a vertical direction.

According to the invention, there is provided a forwarding and cutting method of a heat sensitive adhesive sheet in a printer comprising a printing device including printing means for printing on a printable layer of a heat sensitive adhesive sheet formed by the printable layer on one surface of a sheet-shaped substrate and a heat sensitive adhesive layer on the other surface thereof and first forwarding means for forwarding the heat sensitive adhesive sheet in a predetermined direction, a cutter provided in the posterior stage to the printing device, for cutting the heat sensitive adhesive sheet to a predetermined length, and a thermal activating device including heating means provided in the posterior stage to the cutter, for heating the heat sensitive adhesive layer and second forwarding means for forwarding the heat sensitive adhesive sheet in a predetermined direction, the method in which after temporarily loosening the sheet between the cutter and the thermal activating device according to a speed control of the first forwarding means and the second forwarding means, an operation of the first forwarding means is stopped so as to cut the sheet with the cutter. Thus, since the sheet can be cut by the cutter while forwarding the heat sensitive adhesive sheet by the second forwarding means or before the leading end of the heat sensitive adhesive sheet arrives at the heating means, it is possible to dissolve a disadvantage such as a paper jam caused by attaching the heat sensitive adhesive sheet to the heating means and it is not necessary to a useless maintenance such as discharging a label having caused the paper jam. Accordingly, it is advantageous that the manufacturing efficiency of the stick-on label can be improved extremely.

What is claimed is:

1. A forwarding and cutting method of a heat sensitive adhesive sheet in a printer comprising a printing device including printing means for printing on a printable layer of a heat sensitive adhesive sheet formed by the printable layer on one surface of a sheet-shaped substrate and a heat sensitive adhesive layer on the other surface thereof and first forwarding means for forwarding the heat sensitive adhesive sheet in a predetermined direction, a cutter provided in a posterior stage to the printing device, for cutting the heat sensitive adhesive sheet to a predetermined length, and a thermal activating device including heating means provided in the posterior stage to the cutter, for heating the heat sensitive adhesive layer and second forwarding means for forwarding the heat sensitive adhesive sheet in a predetermined direction, the method characterized in that after temporarily loosening the sheet between the cutter and the thermal activating device according to a speed control of the first forwarding means and the second forwarding means, an operation of the first forwarding means is stopped so as to cut the sheet with the cutter.

2. The forwarding and cutting method of the heat sensitive adhesive sheet as claimed in claim 1, wherein a predetermined length of the sheet is temporarily loosened between the cutter and the thermal activating device by making a forwarding speed of the second forwarding means slower than a forwarding speed of the first forwarding means.

3. The forwarding and cutting method of the heat sensitive adhesive sheet as claimed in claim 1, wherein the second forwarding means is a platen roller for thermal activation arranged opposite to the heating means, and the predetermined length of the sheet is temporarily loosened between the cutter and the thermal activating device according to a speed control of the first forwarding means and the platen roller for thermal activation.

4. The forwarding and cutting method of the heat sensitive adhesive sheet as claimed in claim 1, wherein the second forwarding means is formed by a platen roller for thermal activation arranged opposite to the heating means and a pair of drawing rollers bringing into contact with each other which are provided in a prior stage of the platen roller for thermal activation, and the predetermined length of the sheet is temporarily loosened between the cutter and the thermal activating device according to a speed control of the first forwarding means and the drawing rollers.

5. The forwarding and cutting method of the heat sensitive adhesive sheet as claimed in claim 4, wherein the predetermined length of the sheet is temporarily loosened between the cutter and the thermal activating device, by stopping a rotation of the drawing rollers once at a time when a leading end of the heat sensitive adhesive sheet arrives at a space between the drawing rollers and the platen roller for thermal activation.

6. A printer for a heat sensitive adhesive sheet comprising at least a printing device including printing means for printing on a printable layer of a heat sensitive adhesive sheet formed by the printable layer on one surface of a sheet-shaped substrate and a heat sensitive adhesive layer on the other surface thereof and first forwarding means for forwarding the heat sensitive adhesive sheet in a predetermined direction, a cutter provided in a posterior stage to the printing device, for cutting the heat sensitive adhesive sheet to a predetermined length, a thermal activating device including heating means provided in the posterior stage to the cutter, for heating the heat sensitive adhesive layer and second forwarding means for forwarding the heat sensitive adhesive sheet in a predetermined direction, and a controller capable of individually controlling forwarding speeds of the first forwarding means and the second forwarding means, characterized by including a storage sheet portion having a space capable of loosening a predetermined length of the heat sensitive adhesive sheet between the cutter and the thermal activating device, and sheet guiding means for loosening the heat sensitive adhesive sheet in a predetermined direction.

7. The printer of the heat sensitive adhesive sheet as claimed in claim 6, wherein the sheet guiding means is formed by a first guide provided substantially in parallel with the forwarded heat sensitive adhesive sheet and a second guide provided opposite to the first guide across the forwarded heat sensitive adhesive sheet, and the second guide has a guide portion formed for helping the heat sensitive adhesive sheet loosen in the storage sheet portion.

8. The printer for the heat sensitive adhesive sheet as claimed in claim 6, wherein the sheet guiding means includes discharging direction changing means for specifying a sheet discharging direction from the printing device and inserting direction changing means for specifying a sheet inserting direction to the thermal activating device.

9. The printer for the heat sensitive adhesive sheet as claimed in claim 8, wherein the printing means is a printing thermal head for printing by heating a printable layer of the heat sensitive adhesive sheet, the first forwarding means is a printing platen roller arranged opposite to the printing thermal head, the discharging direction changing means is formed by the printing thermal head and the printing platen roller, and the printing thermal head and the printing platen roller are arranged in such a way that a tangent passing through a junction point of the both is inclined against a straight line connecting a discharge point of the printing device and an insertion point of the thermal activating device, by a predetermined angle.

10. The printer of the heat sensitive adhesive sheet as claimed in claim 8, wherein the heating means is a thermal head for thermal activation for thermal-activating the heat sensitive adhesive layer of the heat sensitive adhesive sheet by heating the above layer, the second forwarding means is a platen roller for thermal activation arranged opposite to the thermal head of thermal activation, the inserting direction changing means is formed by the thermal head for thermal activation and the platen roller for thermal activation, and the thermal head for thermal activation and the platen roller for thermal activation are arranged in such a way that a tangent passing through a junction point of the both is inclined against the straight line connecting the discharge point of the printing device and the insertion point of the thermal activating device, by a predetermined angle.

11. The printer for the heat sensitive adhesive sheet as claimed in claim 8, wherein the second forwarding means includes a pair of drawing rollers bringing contact with each other, which are provided in a sheet inserting portion of the thermal activating device, the inserting direction changing means is formed by the pair of the drawing rollers, and the pair of the drawing rollers are arranged in such a way that a tangent passing through the junction point of the both is inclined against the straight line connecting the discharge point of the printing device and the insertion point of the thermal activating device, by a predetermined angle.

12. The printer of the heat sensitive adhesive sheet as claimed in claim 6, wherein the printing device, the cutter, and the thermal activating device are formed in a way capable of changing each mutual distance.

* * * * *